US007969102B2

(12) United States Patent
Chang

(10) Patent No.: US 7,969,102 B2
(45) Date of Patent: Jun. 28, 2011

(54) INTERACTIVE LED LIGHTING SYSTEM FOR ENTERTAINMENT AND NETWORK THEREOF

(76) Inventor: Chris Chang, Taipei (TW)

( * ) Notice: Subject to any disclaimer, the term of this patent is extended or adjusted under 35 U.S.C. 154(b) by 348 days.

(21) Appl. No.: 12/378,443

(22) Filed: Feb. 17, 2009

(65) Prior Publication Data

US 2009/0206773 A1 Aug. 20, 2009

(51) Int. Cl.
*H05B 37/00* (2006.01)

(52) U.S. Cl. ..... 315/318; 315/312; 315/294; 315/297; 362/227; 362/613; 340/531; 340/539.26; 340/955

(58) Field of Classification Search ..... 315/318, 315/312, 360, 294, 297, 149; 362/227, 249.02, 362/612, 613; 340/955, 531, 539.26; 702/182
See application file for complete search history.

(56) References Cited

U.S. PATENT DOCUMENTS

| | | | | |
|---|---|---|---|---|
| 6,960,892 | B2 * | 11/2005 | Loughrey | 315/294 |
| 7,369,062 | B2 * | 5/2008 | Stokes et al. | 340/945 |
| 2007/0229250 | A1 * | 10/2007 | Recker et al. | 340/531 |
| 2010/0141153 | A1 * | 6/2010 | Recker et al. | 315/149 |

* cited by examiner

*Primary Examiner* — Haissa Philogene

(57) ABSTRACT

An interactive LED lighting system for entertainment and a network thereof comprise a plurality of LED light controllers being capable of connecting with a wireless operating end, a plurality of kinetic energy sensors or wireless remote controls for receiving commands output by the wireless operating end, the kinetic energy sensors or the wireless remote controls so as to generate RGB signals and in turn make LED lamps connected with the LED light controllers change colors they emit.

9 Claims, 5 Drawing Sheets

INTERACTIVE LED LIGHTING SYSTEM FOR ENTERTAINMENT AND NETWORK THEREOF

BACKGROUND OF THE INVENTION

1. Technical Field

The present invention relates to interactive lighting systems, and more particularly, to an interactive LED (Light Emitting Diode) lighting system for entertainment and a network of such lighting system.

2. Description of Related Art

Traditionally, lamplight is provided for illumination and its effect on creating environmental animations is not emphasized. In conventional application of lamplight, different lighting devices are not integrated to work cooperatively and every lighting device can be monotonously switched between on and off statuses. Thus, in traditional technology, it is unachievable to integrate different lighting devices and compose an integral lighting performance by combining different intensities of light, and variations of hues and color temperatures. Nowadays, with the improvement in life quality, modern people do need a lighting system capable of providing changeable lighting effects dynamically conforming to real-time ambiance. Besides, for convenient control and installation, a lighting system capable of working wirelessly and integrating various lighting effects is exactly needed.

SUMMARY OF THE INVENTION

In view of the shortcomings of the prior arts, the primary object of the present invention is to provide an interactive LED lighting system for entertainment and a network thereof, comprising a plurality of LED light controllers being capable of connecting with a wireless operating end, a plurality of kinetic energy sensors or wireless remote controls for receiving a command output by the wireless operating end, the kinetic energy sensors or the wireless remote controls so as to generate RGB signals and in turn make LED lamps connected with the LED light controllers change colors they emit. Each said LED light controller comprises a wireless module IC, a power management IC, a power adapter, an LED driver, an LED driver connector, an audio input connector, a microphone input connector, an input switch, an audio filter, and an audio processor.

Each said kinetic energy sensor comprises a wireless module IC, a G sensor, I2C buses (each having only two lines, namely SDA and SCL, and being a serial interface provided by Royal Philips Electronics Inc.), an access control button, a power management IC, and a power switch.

The wireless remote control comprises a wireless module IC, a liquid crystal display module (LCM), a keyboard input interface, a battery charger unit, a power management IC, a power adaptor, universal asynchronous receivers/transmitters (UARTs), a USB-to-Serial bridge controller (USB to RS-232), and a USB end for connecting with a computer 560 (in order to download data to the wireless remote control or to upload common parameters to the computer 560).

The wireless operating end comprises a wireless module IC, an LED for indicating statuses of the wireless operating end, universal asynchronous receivers/transmitters (UARTs), a USB-to-Serial bridge controller (USB to RS-232), and a USB end for connecting with the computer so that the wireless operating end transmits the RGB signals to the plural LED light controllers according to a scenario preloaded in the computer, thereby causing the LED lamps connected with the LED light controllers to perform an integral and real-time lighting performance.

The wireless module IC comprises a wireless IC chip that includes a central processing unit (CPU), a serial flash memory, an oscillator chip, an antenna, an input/output interface for relaying on wireless transmittal, and a memory slot for receiving external memories.

Thereby, a user can directly operate the computer connected with the wireless operating end or operate the wireless remote control to transmit signals to the plural LED light controllers so that the LED light controllers can make the plural LED lamps connected therewith present an integral dynamic lighting performance. Meantime, the audio input connector of each said LED light controller receives an audio input and then the audio filter and the audio processor convert analogic signals of the audio input in a certain frequency range into digital signals so as to control the lighting of the LED lamps connected with the plural LED light controllers. Thus, in an occasion with the presence of music, such as playing a movie, the microphone input connectors of the plural LED light controllers serve to detect the surrounding voices for the LED light controllers to change the lighting performance of the LED lamps according to variations of the voices in tempo or in tone, thereby the lighting performance can dynamically conform to the scenario of the movie.

Each said kinetic energy sensor primarily comprises the G sensor so that when held or carried by a user who is moving to rhythm, the kinetic energy sensor serves to convert quantitative amounts of the user's movements into electronic signals and transmit the electronic signals to the LED light controllers so that the LED light controllers generate corresponding outputs to make the lighting of the LED lamps connected therewith vary with the user's dancing movements, thereby enhancing entertaining effects.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE PREFERRED EMBODIMENTS

Figure 1:
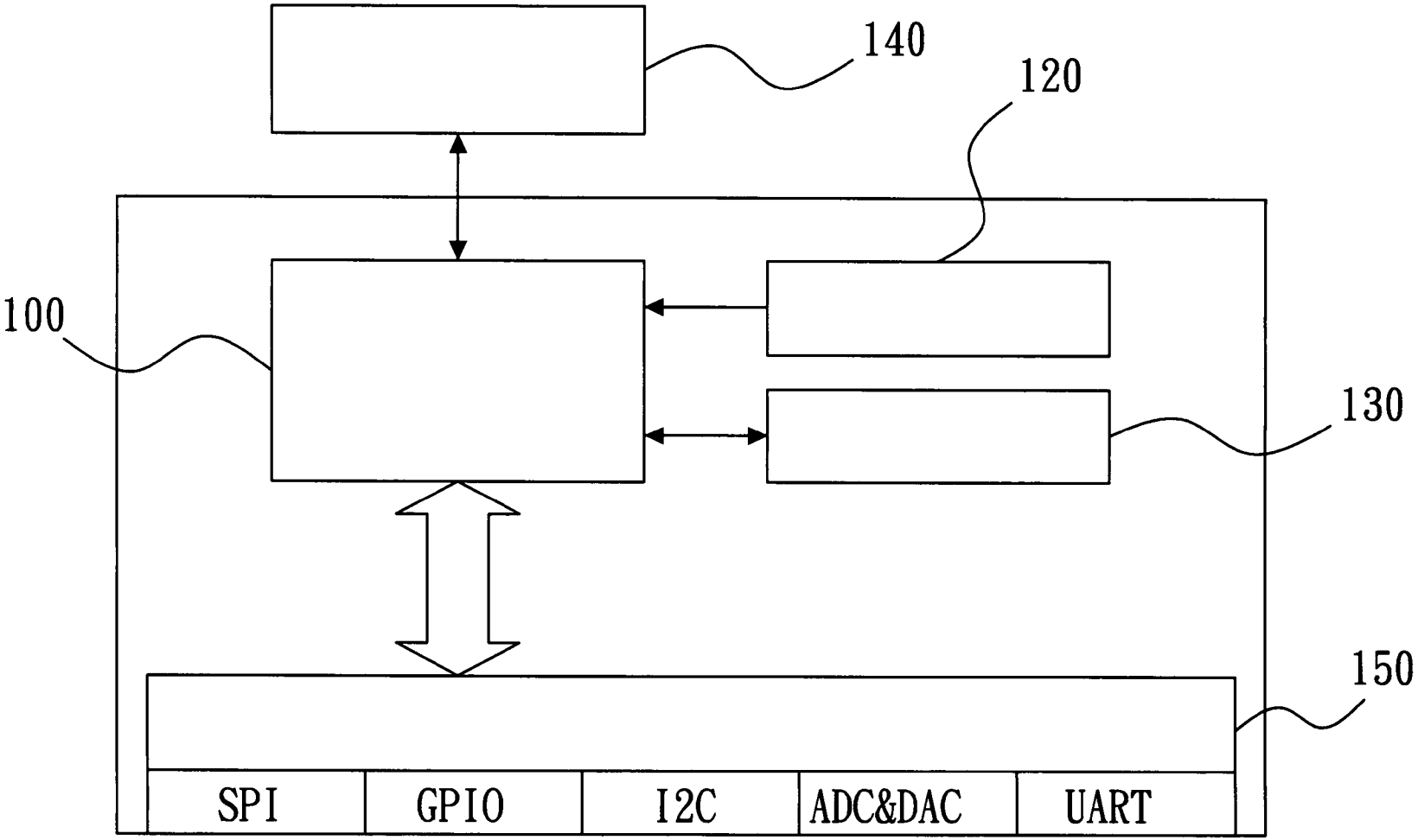
FIG. 1 is a block diagram of a wireless module IC in the lighting system of the present invention.

FIG. 1 is a block diagram illustrating a wireless module IC of the present invention. Therein, the wireless module IC 100, a serial flash memory 130, an oscillator chip 120, an antenna 140, an input/output interface 150 are provided for relaying and processing purposes of wireless transmittal. The wireless module IC is the fundamental component of the lighting system of the present invention and widely used in each of the independent units to play an important role in wireless transmission and processing. As can be seen in FIG. 1, the wireless module IC 100 is an IC chip including a processor, the serial flash memory 130, the oscillator chip 120, the antenna 140, and the input/output interface 150. Therein, the wireless module IC 100 operates in the 2.4 GHz radio frequency and is of the IEEE 802.15.4 specification. When working with the oscillator chip 120 of 16 MHz, the wireless module IC 100 generates RF signals and stores data in the serial flash memory 130 of 1 Mbit. The wireless module IC 100 communicates with the exterior via the input/output interface 150, which may be an SPI bus, a GPIO port, an I2C bus, an ADC/DAC (Analog-to-Digital Input switch/Digital-to-Analog Input switch) or a universal asynchronous receiver/transmitter (UART), according to practical needs. The wireless module IC further comprises the antenna 140, which is an exposed antenna or a ceramic antenna for the frequency 2.4 GHz. Therein, the wireless module IC may be one produced by Jennic Limited.

Figure 2:
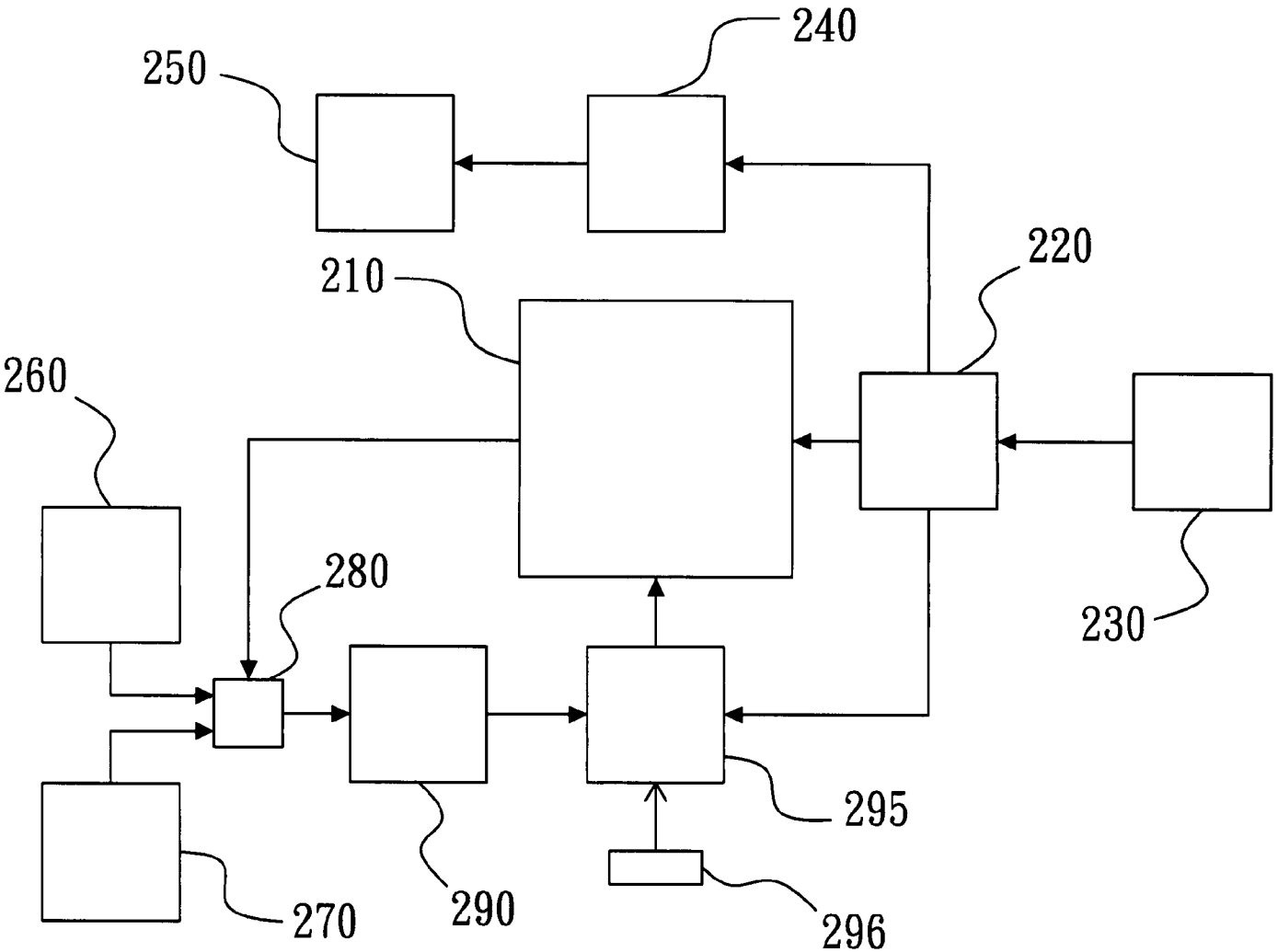
FIG. 2 is a block diagram of an LED light controller in the lighting system of the present invention.
Figure 5:
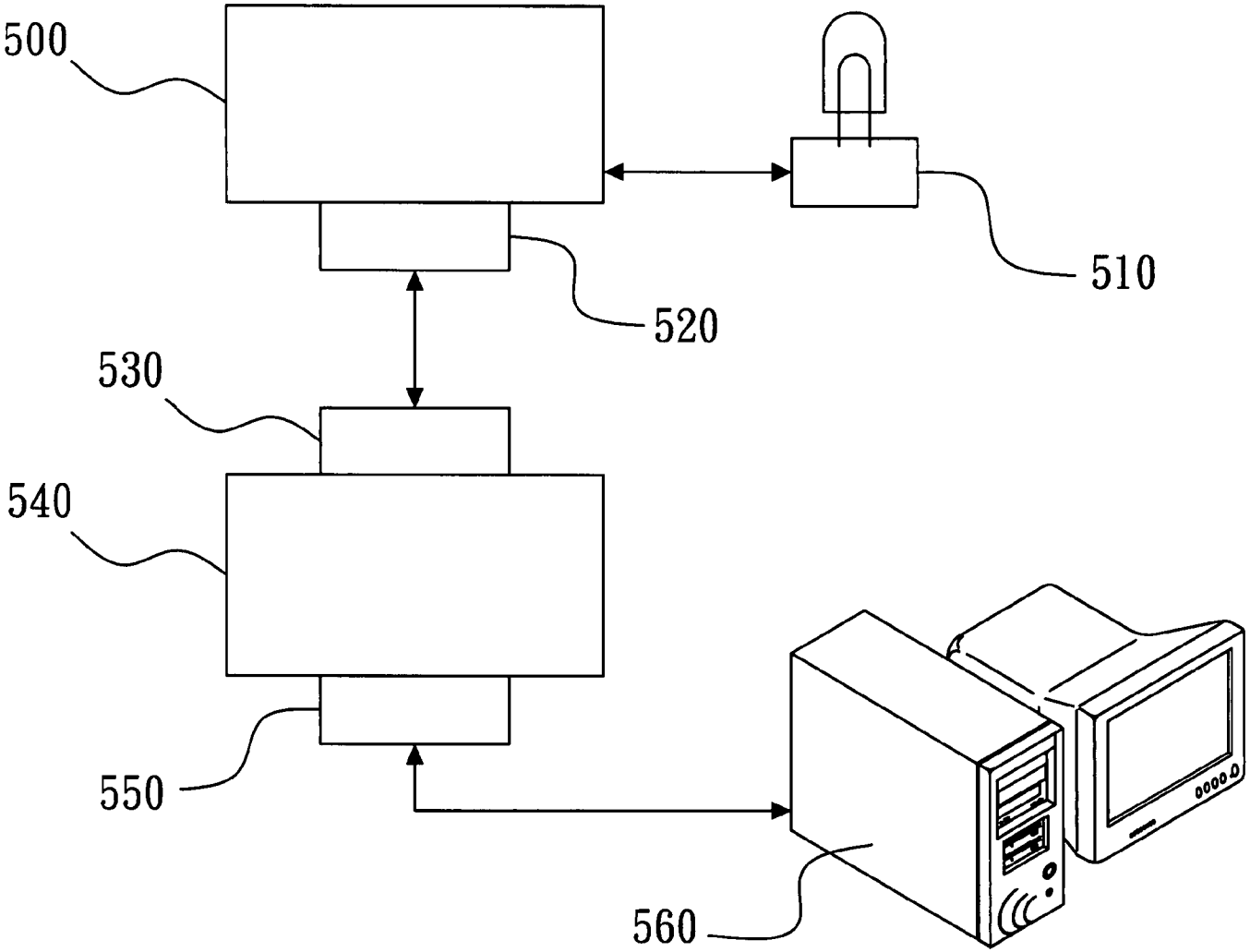
FIG. 5 is a block diagram of a wireless operating end in the lighting system of the present invention.

FIG. 2 is a block diagram of one of plural LED light controllers used in the present invention, wherein the plural LED light controllers are capable of wirelessly connecting with other components of the lighting system. The LED light controller is capable of connecting with a wireless operating end, a plurality of kinetic energy sensors, or wireless remote controls for receiving signals output by the wireless operating end, the kinetic energy sensors, or the wireless remote controls so as to generate RGB signals and in turn make LED lamps connected with the LED light controller change colors they emit. The LED light controller comprises a wireless module IC 210, a power management IC 220, a power adapter 230, an LED driver 240, an LED driver connector 250, an audio input connector 260, a microphone input connector 270, an input switch 280, an audio filter 290, an audio processor 295, and a spectrum unit 296. Therein, the wireless module IC 210 is similar to that illustrated according to FIG. 1 and needs not to be described at length herein. The plural LED light controllers act as connection relays in the wireless network of present invention. That is, all the components are intercommunicated via the wireless network devices of the LED light controllers (i.e. the wireless module ICs) so as to achieve device binding. In other words, the kinetic energy sensors, the wireless remote controls, the wireless operating end connecting with a computer 560 (as shown in FIG. 5), and the plural LED light controllers are thus strung up to form a close network for wireless data transmission. The LED light controllers also serve to control lighting variation of the LED lamps connected therewith according to a scenario preloaded in the wireless module IC 210, which may have a serial flash memory 130 of 1 Mbit as that in the wireless module IC, and direct the LED light controllers to cooperatively change the lighting of the LED lamps so as to perform an integral dynamic lighting performance.

The LED light controller transmits the RGB signals to the LED lamps through the LED driver 240 and the LED driver connector 250, and then converts the signals into those conforming to the DMX512 standard, which was originally developed by the United States Institute for Theatre Technology (USITT) as a communication protocol between the console and dimmers for stage lighting and later has its application expanded to computer lights and color changers, or into PWM signals for controlling the LED lamps.

The audio input connector 260 of each said LED light controller receives an audio input and then the audio filter 290 and the audio processor 295 convert analogic signals of the audio input in a certain frequency range into digital signals so as to control the lighting of the LED lamps connected with the LED light controller. Thus, in an occasion with the presence of music, such as playing a movie, the microphone input connectors 270 of the plural LED light controllers serve to detect the surrounding voices for the LED light controllers to alter the lighting performance of the LED lamps according to variation of the voices in tempo or in tone, thereby the lighting performance can dynamically conform to the scenario of the played movie. Alternatively, a spectrum of a piece of music can be directly input to the audio processor 295 through the spectrum unit 296 so as to achieve the same result. Therein, the audio input connector 260 and the microphone input connector 270 are alternately switched by the input switch 280 so as to avoid interference between the two channels. The audio filter 290 may be the commercially available IC chip bearing the model name MAX293. The audio processor 295 may be the commercially available IC chip bearing the model name STM32F 101C6. The input switch 280 is directly controlled by the wireless module IC 210 to select the voice source from either the audio input connector 260 or the microphone input connector 270. The LED driver 240 may be the commercially available IC chip bearing the model name 74LV00D. The power management IC 220 mainly serves to properly allot power to the LED driver 247, the wireless module IC 210, and the audio processor 295 according to the levels of power consumption of these components. For example, when there are many LED lamps serially connected with the LED driver 247, the power management IC 220 supplies more power for the LED driver 247 to drive the LED lamps. When the entire circuit is overloaded, the power management IC 220 cuts off the power supply so as to ensure use safety. The power management IC 220 is electrically supported by the power adaptor 230, which serves to convert an alternating current from the grid into a pure direct current without noises so as to ensure integrity of the electronic components connected with the power management IC 220.

Figure 3:
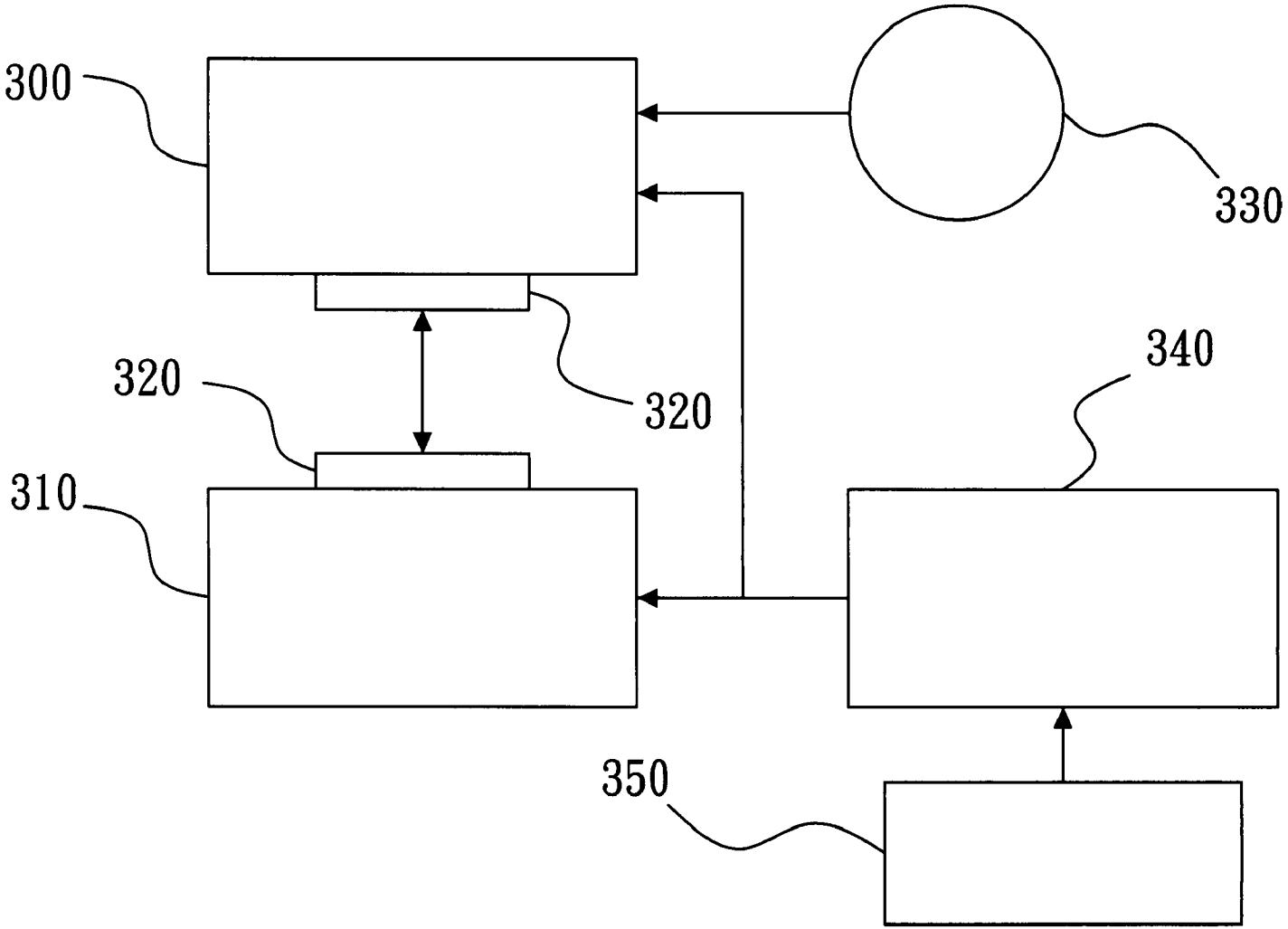
FIG. 3 is a block diagram of a kinetic energy sensor in the lighting system of the present invention.

FIG. 3 is a block diagram describing one of the kinetic energy sensors of the present invention. The kinetic energy sensor primarily comprises a G sensor 310 so that when held or carried by a user who is moving to rhythm, the kinetic energy sensor serves to convert quantitative amounts of the user's movements into electronic signals and transmit the electronic signals to the LED light controllers so that the LED light controllers generate corresponding outputs to make the lighting of the LED lamps connected therewith vary with the user's dancing movements, thereby enhancing entertaining effects. The kinetic energy sensor also comprises a wireless module IC 300 functionally similar to those described above, and two I2C buses 320 (each having only two lines, namely SDA and SCL, and being a serial interface provided by Royal Philips Electronics Inc.) acting as a connection interface between the wireless module IC 300 and the G sensor 310. The kinetic energy sensor further has an access control button 330, a power management IC 340, and a power switch 350. Therein, the access control button 330 serves to send out a signal requiring connection between the kinetic energy sensor and the LED light controllers. The power management IC 340 requires two AAA batteries and provides a 3.3V power supply as a power source for the kinetic energy sensor to operate independently. When the G sensor 310 detects no movement, the power management IC 340 stops the power supply so as to maximize the battery life. The power switch 350 allows a user to operate the same to actively and immediately turn off the power supply when he/she intends to stop using the kinetic energy sensor.

Figure 4:
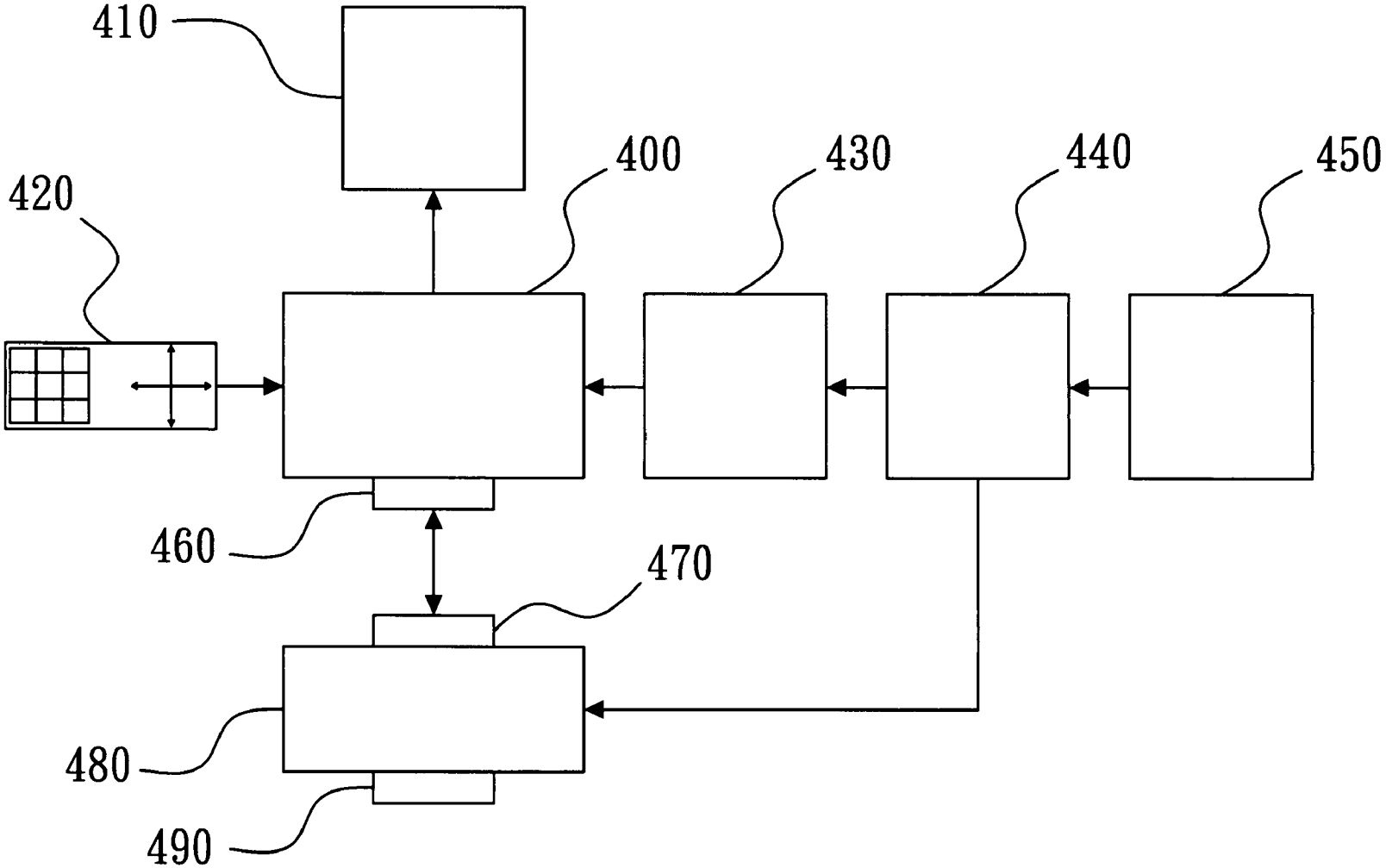
FIG. 4 is a block diagram of a wireless remote control in the lighting system of the present invention.

FIG. 4 is a block diagram of the wireless remote control of the present invention. The wireless remote control comprises a wireless module IC 400, a liquid crystal display module (LCM) 410, a keyboard input interface 420, a battery charger unit 430, a power management IC 440, a power adaptor 450, universal asynchronous receivers/transmitters (UARTs) 460, 470, a USB-to-Serial bridge controller (USB to RS-232) 480, and a USB end 490 for connecting with a computer (in order to download data to the wireless remote control or to upload common parameters to the computer).

Therein, the wireless module IC 400, the power management IC 440 and the power adaptor 450 are functionally similar to those having the same names described above and need not to be illustrated at length herein. It is to be noted that the LCM 410 is a liquid crystal screen for displaying operational statuses and function menus of the lighting system, and may be the commercially available liquid crystal display module bearing the model name ST7541. The keyboard input interface 420 may be a light, simple keyboard or keys made of flexible rubber as that used for making keys of general remote controls, wherein the keys may be provided for satisfying the operational needs of the function menus. The battery charger unit 430 includes rechargeable batteries for storing energy. The UARTs 460 and 470 enable communication between the wireless module IC 400 and the USB-to-Serial bridge controller (USB to RS-232) 480. The USB-to-Serial bridge controller (USB to RS-232) 480 converts signals from the RS232 interface into those readable to the USB interface for connecting with the computer. The USB end 490 for connecting with the computer (in order to download data to the wireless remote control or to upload common parameters to the computer). The main scenario functions of the wireless remote control may include lighting modes of a music listening mode, a movie watching mode, a dancing mode, an exercising mode, a game playing mode, a normal lighting mode, a lighting show mode, and a computer-controlled mode where the lighting performance is controlled by the computer. All the aforementioned modes are executed by preprogrammed logic or realized by preset RGB signals.

FIG. 5 is a block diagram of the wireless operating end of the present invention. The wireless operating end comprises a wireless module IC 500, an LED 510 for indicating statuses of the wireless operating end, universal asynchronous receivers/transmitters (UARTs) 520 and 530, a USB-to-Serial bridge controller (USB to RS-232) 540, and a USB end 550 for connecting with the computer 560 so that the wireless operating end transmits the RGB signals to the plural LED light controllers according to a scenario preloaded in the computer 560, thereby causing the LED lamps connected with the LED light controllers to perform an integral and real-time lighting performance.

The present invention provides the following lighting modes for option:

I. When the microphone input connectors 270 of the LED light controllers are taken to dominate the lighting performance (namely using the external voices to control the lighting performance of the LED lamps), the lighting performance being achieved by: 1. Selecting the "music listening mode" or the "movie watching mode" through the wireless remote control; 2. Selecting a "Style" item preloaded in the wireless module IC 210; 3. Detecting sound waves in a certain frequency range with the LED light controllers having the microphone input connectors 270; 4. Converting analogic signals of the sound waves detected by the microphone input connectors 270 into digital signals through an FFT (Fast Fourier Transform) process in the audio processor 295; 5. Processing the digital signals with the wireless modules ICs 210 in the LED light controllers and generating color data of RGB signals according to the selected style item, wherein the color data conform to the DMX512 standard or are PWM signals; and 6. Transmitting the data to the LED drivers 240 and then transmitting the data to the LED lamps through the LED driver connectors 250 for controlling lighting of the LED lamps. This mode is especially applicable to the LED lighting system containing plural LED light controllers settled at different positions so that when receiving different intensities of voices due to positional differences, the LED light controllers make the LED lamps connected therewith generate different lighting variations.

II. When voices are directly input to the audio filter 290, and the LED light controllers are mutually connected, the lighting performance being achieved by: 1. Selecting the "music listening mode" or the "movie watching mode" through the wireless remote control; 2. Selecting a "Style" item preloaded in the wireless module IC 210; 3. Inputting the audio signals into the audio filters 290 of the LED light controllers; 4. Receiving the analogic audio signals at an audio input slot of the audio filter 290 and converting the analogic audio signals into digital signals through an FFT process in the audio processor 295; 5. Processing the digital signals with the wireless modules ICs 210 in the LED light controllers and generating color data of RGB signals according to the selected style item, wherein the color data conform to the DMX512 standard or are PWM signal; and 6. Transmitting the data to the LED drivers 240 of the LED light controllers and then transmitting the data to the LED lamps through the LED driver connectors 250 for controlling lighting of the LED lamps. This mode is especially applicable to the LED lighting system containing plural LED light controllers that are mutually connected so that one of the LED light controllers serves to transmit the control signals to inform the other LED light controllers of the scenario to be adopted so that the LED light controllers can work cooperatively to give a lighting performance according to the scenario. Therein, the LED light controllers are connected through a wireless network.

III. When the kinetic energy sensor is taken to dominate the lighting performance of the LED lamps (namely using the external kinetic energy to control the lighting performance of the LED lamps), the lighting performance being achieved by: 1. Selecting the "dancing mode", the "game playing mode", or the "exercising mode" through the wireless remote control; 2. Selecting a "Style" item preloaded in the wireless module IC 210; 3. Turning on the kinetic energy sensor and connecting the same with the LED light controllers; 4. Collecting data of acceleration in X, Y and Z directions with the kinetic energy sensor; 5. Processing signals of the data with the wireless modules ICs 210 in the LED light controllers and generating color data of RGB signals according to the selected style item, wherein the color data conform to the DMX512 standard or are PWM signal; and 6. Transmitting the color data to the LED drivers 240 and then transmitting the color data to the LED lamps through the LED driver connectors 250 for controlling lighting of the LED lamps. This mode enables the dynamic lighting performance varying with a user's real-time movements.

IV. When the computer 560 is taken to dominate the lighting performance of the LED lamps, the lighting performance being achieved by: 1. Selecting the "computer-controlled mode" through the wireless remote control; 2. Selecting a "Style" item preloaded in the wireless module IC 210; 3. Receiving commands and setting at the wireless operating end from the computer 560 at the LED light controllers; 4. Processing signals of the commands and setting with the wireless modules ICs 210 in the LED light controllers and generating color data of RGB signals according to the selected style item, wherein the color data conform to the DMX512 standard or are PWM signal; and 5. Transmitting the data to the LED drivers 240 and then transmitting the data to the LED lamps through the LED driver connectors 250 for controlling lighting of the LED lamps. This mode features for presenting the lighting performance according to the commands from the computer 560.

V. When the normal lighting mode is desired, the lighting performance being achieved by: 1. Selecting the "normal lighting mode" through the wireless remote control; 2. Selecting a "Style" item preloaded in the wireless module IC 210; 3. Receiving commands and setting at the LED light controllers; 4. Processing signals of the commands and setting with the wireless modules ICs 210 in the LED light controllers and generating color data of RGB signals according to the selected style item, wherein the color data conform to the DIMX512 standard or are PWM signal; and 5. Transmitting the data to the LED drivers 240 and then transmitting the data to the LED lamps through the LED driver connectors 250 for controlling lighting of the LED lamps.

VI. When the lighting show mode is desired, the lighting performance being achieved by: 1. Selecting the "lighting show mode" through the wireless remote control; 2. Selecting a "Style" item preloaded in the wireless module IC 210; 3. Receiving commands and setting at the LED light controllers; 4. Processing signals of the commands and setting with the wireless modules ICs 210 in the LED light controllers and generating color data of RGB signals according to the selected style item, wherein the color data conform to the DMX512 standard or are PWM signal; and 5. Transmitting the data to the LED drivers 240 and then transmitting the data to the LED lamps through the LED driver connectors 250 for controlling lighting of the LED lamps.

What is claimed is:

1. An interactive LED lighting system for entertainment and a network thereof, comprising:

a plurality of LED light controllers being wirelessly connecting with at least one wireless operating end, a plurality of kinetic energy sensors, other LED light controllers and a wireless remote control for receiving commands from the wireless operating end, the kinetic energy sensors, said other LED light controllers and the wireless remote control so as to generate RGB signals and in turn make LED lamps connected with the LED light controllers change colors they emit.

2. The interactive LED lighting system and the network thereof as claimed in claim 1, wherein the LED light controller comprises a wireless module IC, a power management IC, a power adapter, an LED driver, an LED driver connector, an audio input connector, a microphone input connector, an input switch, an audio filter, and an audio processor.

3. The interactive LED lighting system and the network thereof as claimed in claim 1, wherein the kinetic energy sensor comprises a wireless module IC, a G sensor, I2C buses, an access control button, a power management IC, and a power switch.

4. The interactive LED lighting system and the network thereof as claimed in claim 1, wherein the wireless remote control comprises a wireless module IC, a liquid crystal display module (LCM), a keyboard input interface, a battery charger unit, a power management IC, a power adaptor, universal asynchronous receivers/transmitters (UARTs), a USB-to-Serial bridge controller (USB to RS-232), and a USB end for connecting with a computer in order to download data to the wireless remote control or to upload common parameters to the computer.

5. The interactive LED lighting system and the network thereof as claimed in claim 1, wherein the wireless operating end comprises a wireless module IC, an LED for indicating statuses of the wireless operating end, universal asynchronous receivers/transmitters (UARTs), a USB-to-Serial bridge controller (USB to RS-232), and a USB end for connecting with a computer so that the wireless operating end transmits the RGB signals to the plural LED light controllers according to a scenario preloaded in the computer, thereby causing the LED light controllers to perform an integral and real-time lighting performance.

6. The interactive LED lighting system and the network thereof as claimed in claim 1, wherein the wireless module IC is a wireless IC chip that includes a central processing unit (CPU), a serial flash memory, an oscillator chip, an antenna, an input/output interface for relaying on wireless transmittal.

7. The interactive LED lighting system and the network thereof as claimed in claim 2, wherein the audio input connector of each said LED light controller receives an audio input and then the audio filter and the audio processor convert analogic signals of the audio input in a certain frequency range into digital signals so as to control the LED lighting connected with the plural LED light controllers.

8. The interactive LED lighting system and the network thereof as claimed in claim 1, wherein the kinetic energy sensor primarily comprises the G sensor so that when held or carried by a user who is moving to rhythm, the kinetic energy sensor serves to convert quantitative amounts of the user's movements into electronic signals and transmit the electronic signals to the LED light controllers so that the LED light controllers generate corresponding outputs to make the lighting of the LED lamps connected with the LED light controllers vary with the user's dancing movements, thereby enhancing entertaining effects.

9. The interactive LED lighting system and the network thereof as claimed in claim 1, wherein the network is an IEEE 802.15.4 network.

* * * * *